US006733242B2

(12) United States Patent
Yung

(10) Patent No.: US 6,733,242 B2
(45) Date of Patent: May 11, 2004

(54) MOUNTING MECHANISM FOR CEILING FAN OUTER CASING

(75) Inventor: Yau Yung, Chai Wan (HK)

(73) Assignee: Shell Electric Mfg. (Holdings) Co., Ltd., Chai Wan Industrial District (HK)

( * ) Notice: Subject to any disclaimer, the term of this patent is extended or adjusted under 35 U.S.C. 154(b) by 19 days.

(21) Appl. No.: 10/301,574

(22) Filed: Nov. 22, 2002

(65) Prior Publication Data

US 2003/0210983 A1 Nov. 13, 2003

(30) Foreign Application Priority Data

May 8, 2002 (CN) ..... 02231292 U

(51) Int. Cl.[7] ..... F04D 29/64
(52) U.S. Cl. ..... 416/244 R; 248/318
(58) Field of Search ..... 416/5, 244 R, 416/246; 348/318, 342, 344

(56) References Cited

U.S. PATENT DOCUMENTS 4,410,160 A 10/1983 Alperin et al.

FOREIGN PATENT DOCUMENTS

CN 99256601.0 1/2001

*Primary Examiner*—Edward K. Look
*Assistant Examiner*—Kimya N McCoy
(74) *Attorney, Agent, or Firm*—Rabin & Berdo, P.C.

(57) ABSTRACT

The present utility model relates to an improved mounting mechanism for ceiling fan outer casing. The ceiling fan outer casing is fixed on the support of the motor through mounting members, the mounting members comprising a pair of convex fixing members and a pair of concave fixing members corresponding to and matched in use with said convex fixing members, on each of said convex fixing members is provided a pair of protruding elements transversely spaced and arranged in parallel, the upper end of said two protruding elements is each provided at one outward side with a hook respectively, on each of said concave fixing members is provided a receiving groove which has one end opening and is inverted "Y" in shape receiving said convex fixing members, the two opposite sides of one end of said receiving groove are provided respectively with recessed portions matched with said hooks.

3 Claims, 2 Drawing Sheets

MOUNTING MECHANISM FOR CEILING FAN OUTER CASING

BACKGROUND OF THE INVENTION

A mounting mechanism for ceiling fan outer casing is disclosed in the U.S. Pat. No. 4,410,160, which comprises several protruding elements preset on ceiling fan support onto the ceiling and U-shaped grooves with one end opened upward set on the upper edge of ceiling fan motor outer casing and in number corresponding to said protruding elements. Its main drawback is: Since the ceiling fan has a certain weight and its mounting work is carried out at a rather high position near ceiling in the room, also since the protruding elements and corresponding grooves are all small in size, it is not easy to align several U-shaped grooves on the ceiling fan simultaneously to protruding elements on the support of the ceiling fan, so as to be necessary to do numerous trials or attempts. Moreover, due to its own weight and in case of a longer duration, it will make people tired to possibly cause an accident.

The China Utility Model Patent No.99256601.0 is a patent already granted to the applicant, which adopts a outer casing directly to be hanged on the ceiling fan motor already mounted, hence it is a mounting mechanism not quite laborious to be fitted on the outer casing. That mechanism comprises concave fixing members provided on both sides of the support for a motor and convex fixing members provided on the inner edge of outer casing and matched with the concave fixing members. Although the receiving grooves on the concave fixing members adopt "Y" opening to facilitate aligning corresponding protruding elements on convex fixing members, there are still imperfections existing in mounting and safety, possible for further improvement and perfection.

SUMMARY OF THE INVENTION

The object of the present utility model is to provide an improved mounting mechanism for ceiling fan outer casing and to make the engagement of concave fixing members and convex fixing members more accurate and easier with higher safety.

The object of the present utility model is realized as such: The ceiling fan outer casing is fixed on the support for a motor through mounting members, said mounting members comprising at least a pair of convex fixing members and a pair of concave fixing members corresponding to and matched in use with said convex fixing members, characterized in that on each of said convex fixing members is provided a pair of protruding elements transversely spaced and arranged in parallel, the upper end of said two protruding elements is provided at each one outward side with one hook respectively, on each of said concave fixing members is provided a receiving groove which has one end opening receiving said convex fixing members and is in the shape of an inverted "Y" at the inlet, the two opposite sides of one end of said receiving groove are provided with recessed portions matched with said hooks respectively.

On said convex fixing members is provided further at least one stop piece. Said stop pieces are provided respectively on the two sides of the lower end of said convex fixing members and stretch outward each along a direction perpendicular to said convex fixing members.

Obviously, the mounting mechanism for ceiling fan outer casing of the present utility model by engagement of concave fixing members provided on ceiling fan support with convex fixing members provided on the upper edge of ceiling fan motor outer casing corresponding to and matching in use with said concave fixing members can make mounting convenient, labour saving, and with higher safety.

BRIEF DESCRIPTION OF DRAWINGS

In the following the embodiments of the present utility model will be described with reference to the accompanying drawings, in such drawings.

DETAILED DESCRIPTION OF PREFERRED EMBODIMENT

Figure 1:
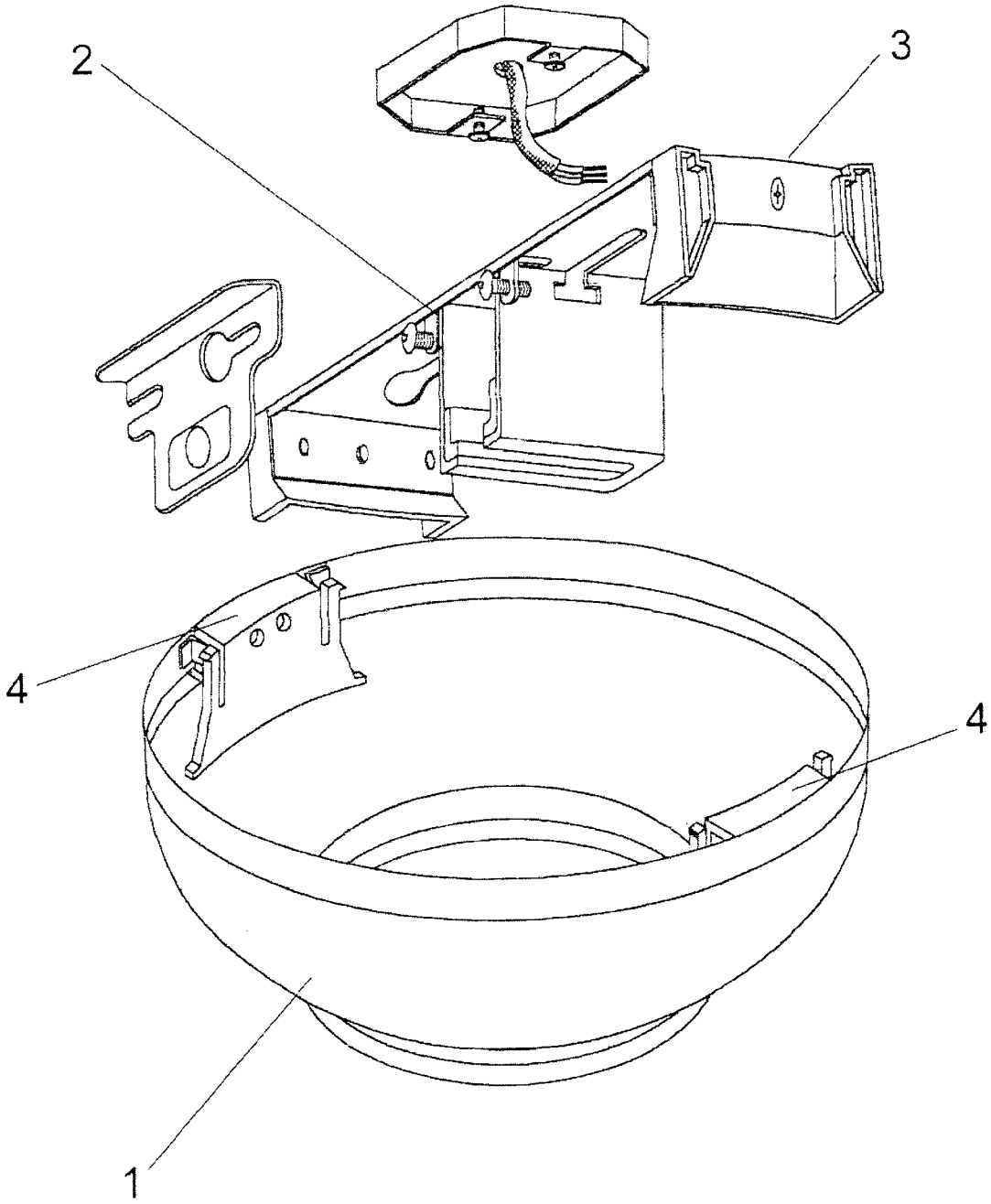
FIG. 1 is a schematic diagram of mounting mechanism for ceiling fan outer casing of the present utility model.
Figure 2:
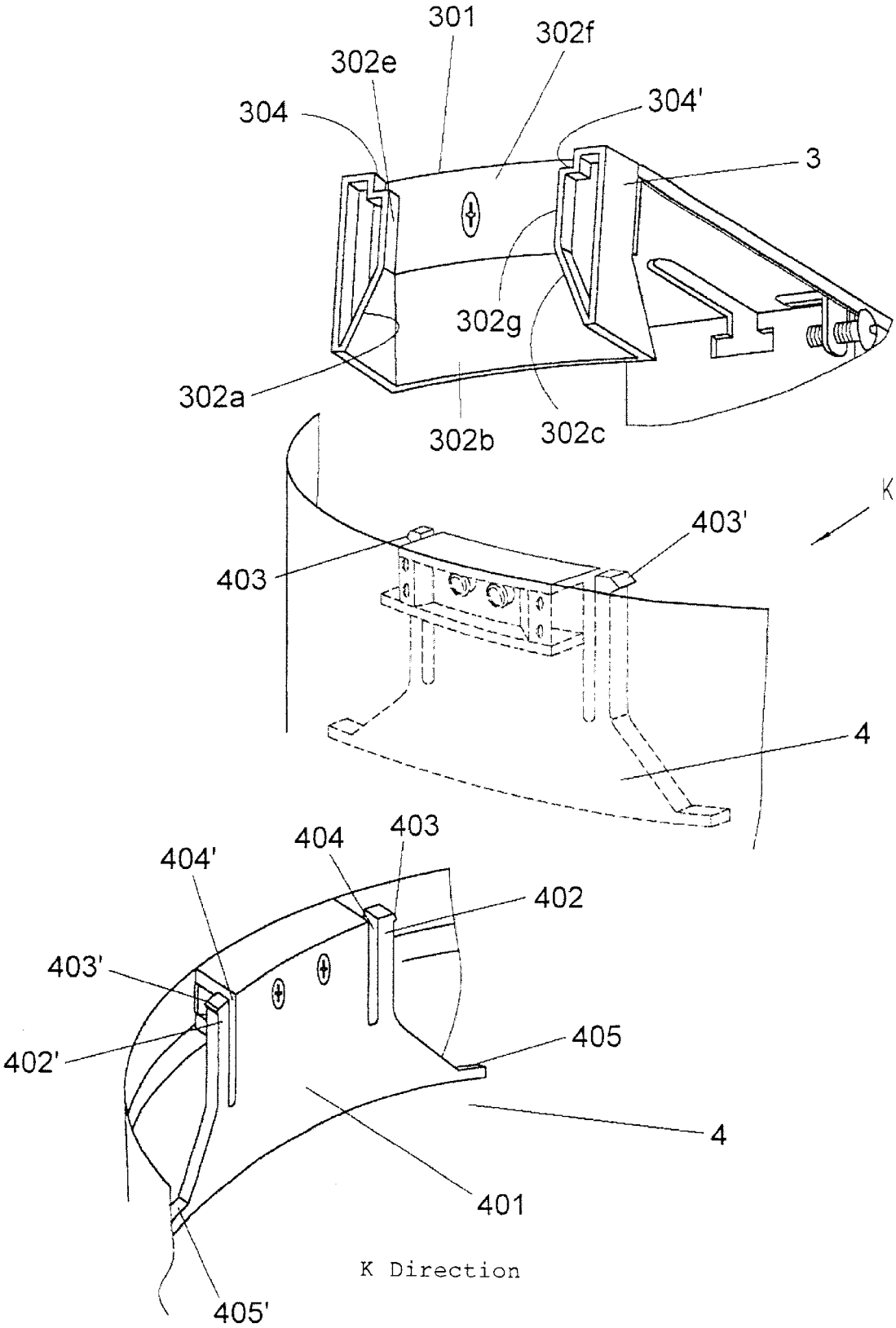
FIG. 2 is a schematic diagram of convex fixing members and concave fixing members in correspondence and matched in use therewith of mounting mechanism of the present utility model.

The mounting mechanism for ceiling fan outer casing 1 of the present utility model comprises a pair of concave fixing members 3 fixedly set on either sides of support 2 for a motor respectively, and a pair of convex fixing members 4 fixedly set on two sides of the inner edge of ceiling fan outer casing 1 respectively, as shown in FIG. 1 and FIG. 2.

As shown in FIG. 2, the upper end of two sides of each convex fixing member 4 is provided with protruding element 402 and 402' respectively, with the two protruding elements being transversely spaced and arranged in parallel. The upper end edge of two protruding elements 402 and 402' is provided at each of outward sides with a hook 403 and 403' respectively, of which the surface is roughly perpendicular to protruding elements and wedge-shaped. The protruding elements 402 and 402' and the hooks 403 and 403' are elastic and may be made of elastic material. The maximum distance between the two protruding elements 402 and 402' is the width of convex fixing member 4. The opposite sides of protruding elements 402 and 402' with hooks 403 and 403' are provided respectively with recesses 404 and 404', with one end open while the other enclosed and parallel to protruding elements roughly.

The lower end of convex fixing members 4 is provided with at least one stop piece, preferably to provide one stop piece 405 and 405' respectively, at either sides of its lower end. Stop pieces 405 and 405' stretch outward each along a direction roughly perpendicular to said protruding elements 402 and 402' respectively. One side edge of stop pieces 405 and 405' is positioned on the same concave-arc surface with the front wall of convex fixing members 4.

On each concave fixing member 3, there is provided a receiving groove 301 which has one end opening receiving the convex fixing member 4 and is in the shape of an inverted "Y" at its inlet. The receiving groove 301 is composed of both an upper portion and a lower portion. Its lower portion is joined by three side walls 302*a*, 302*b* and 302*c* in trapeze-shape and enclosed into a "Y"-shaped inlet from large to small, and its upper portion is joined by three side walls 302*e*, 302*f* and 302*g* and encircled into a rectangular groove body, wherein the upper end of two opposite side walls 302*e* and 302*g* is provided respectively with recessed portions 304 and 304' matched with said hooks 403 and 403'. The outer surface of concave fixing members 3 is convex arc in shape and is adaptable to be matched with the concave arc outer surface of the convex fixing members 4.

The spacing of two side walls 302*e* and 302*g* is slightly larger than the width of the body of convex fixing members 4, but less than the spacing between two hooks 403 and 403', so as to make the convex fixing member 4 just pass the inside of rectangular groove body joined and enclosed by three side walls 302*e*, 302*f* and 302*g*. When the two elastic hooks 403 and 403' on protruding elements 402 and 402' enter into two side walls 302*e* and 302*g* from the bottom side of the inlet of receiving groove 301, the two hooks 403 and 403' under pressure can be inclined to recesses 404 and 404' respectively. When mounting ceiling fan outer casing 1, the convex fixing members 4 on the two sides of the inner edge of outer casing 1 are aligned to the "Y"-shaped inlets of concave fixing members 3 provided on two sides of support 2 of the motor and pushed from the bottom to top to put the convex fixing member 4 into the receiving groove 301. When convex fixing members 4 enter the rectangular groove body from the "Y"-shaped inlet of receiving groove, the wedge-shaped hooks 403 and 403' on protruding elements 402 and 402' because of being elastic are compressed toward inner side by two side walls 302*e* and 302*g* opposite to the rectangular groove body to make convex fixing members 4 pass through the groove body. When the wedge-shaped hooks 403 and 403' on protruding elements 402 and 402' pass through the groove body to reach recessed portions 304 and 304' of concave fixing members 3, hooks 403 and 403' will be restored to their original state and be held on the recessed portions of the upper end of two side walls 302*e* and 302*g* in the receiving groove, while stop pieces 405 and 405' at the lower side edge of convex fixing members 4 will then be abutted against the bottom edge of concave fixing members 3, thereby mounting outer casing 1 on support 2 of the motor stably.

Summing up the above, the improved mounting mechanism for ceiling fan outer casing of the present utility model will make mounting more convenient, labour saving and rapid.

It should be pointed out that the embodiments illustrated above are only two preferred embodiments, it is obvious that without departing from the protection scope of the claims of the present utility model, a variety of modifications and changes can be made to the present utility model. However these changes and modifications will still fall into the protection scope of the present utility model.

What is claimed is:

1. A mounting mechanism for ceiling fan outer casing, with said ceiling fan outer casing being fixed on the support for a motor through mounting members, said mounting members comprising at least a pair of convex fixing members and a pair of concave fixing members corresponding to and matched in use with said convex fixing members, characterized in that on each of said convex fixing members (4) is provided a pair of protruding elements (402, 402') transversely spaced and arranged in parallel, the upper end of said two protruding elements is provided at each one outward side with one hook (403, 403') respectively, on each of said concave fixing members (3) is provided a receiving groove (301) which has one end opening receiving said convex fixing members (4) and is in the shape of an inverted "Y" at the inlet, the two opposite sides of one end of said receiving groove are provided with recessed portions (304, 304') matched with said hooks respectively.

2. A mounting mechanism for ceiling fan outer casing according to claim 1, characterized in that on said convex fixing members (4) is provided further at least one stop piece.

3. A mounting mechanism for ceiling fan outer casing according to claim 2, characterized in that said stop pieces (405,405') are provided respectively on the two sides of the lower end of said convex fixing members (4) and stretch outward each along a direction perpendicular to said convex fixing members (402,402').

* * * * *